US006883605B2

(12) United States Patent
Arceneaux et al.

(10) Patent No.: US 6,883,605 B2
(45) Date of Patent: Apr. 26, 2005

(54) WELLBORE CLEANOUT TOOL AND METHOD

(75) Inventors: Thomas K. Arceneaux, Lafayette, LA (US); Albert Augustus Mullins, Boling, TX (US)

(73) Assignee: Offshore Energy Services, Inc., Broussard, LA (US)

( * ) Notice: Subject to any disclaimer, the term of this patent is extended or adjusted under 35 U.S.C. 154(b) by 35 days.

(21) Appl. No.: 10/306,101

(22) Filed: Nov. 27, 2002

(65) Prior Publication Data

US 2004/0099413 A1 May 27, 2004

(51) Int. Cl.[7] ..... E21B 37/02

(52) U.S. Cl. ..... 166/171; 166/173; 166/202; 166/312

(58) Field of Search ..... 166/311, 177.3, 166/312, 202, 173, 172, 171, 170

(56) References Cited

U.S. PATENT DOCUMENTS

| | | | | | |
|---|---|---|---|---|---|
| 2,073,126 | A | | 3/1937 | Sweet | |
| 2,191,702 | A | * | 2/1940 | Yowell | 166/184 |
| 2,362,198 | A | * | 11/1944 | Gibson | 166/173 |
| 2,433,828 | A | * | 1/1948 | Cassell | 161/101 |
| 2,464,669 | A | * | 3/1949 | Brown | 166/306 |
| 2,512,801 | A | | 6/1950 | Kinney et al. | |
| 2,782,860 | A | | 2/1957 | Tausch et al. | |
| 2,829,717 | A | * | 4/1958 | Brown | 166/131 |
| 2,959,224 | A | | 11/1960 | Ault | |
| 3,500,933 | A | * | 3/1970 | Burba, Jr et al. | 166/311 |
| 3,760,878 | A | | 9/1973 | Peevey | |
| 3,775,805 | A | | 12/1973 | Mitchell et al. | |
| 3,958,651 | A | | 5/1976 | Young | |
| 4,474,240 | A | | 10/1984 | Oliver, Jr. et al. | |
| 4,630,691 | A | | 12/1986 | Hooper | |
| 4,671,355 | A | | 6/1987 | Strange | |
| 4,892,145 | A | | 1/1990 | Stafford | |
| 4,921,046 | A | * | 5/1990 | Caskey | 166/170 |
| 4,944,348 | A | | 7/1990 | Whiteley et al. | |
| 5,030,291 | A | | 7/1991 | Titmas | |
| 5,033,545 | A | | 7/1991 | Sudol | |
| 5,069,286 | A | | 12/1991 | Roensch et al. | |
| 5,269,384 | A | | 12/1993 | Cherrington | |
| 5,318,128 | A | | 6/1994 | Johnson et al. | |
| 5,402,850 | A | | 4/1995 | Lalande et al. | |
| 5,419,397 | A | | 5/1995 | Reynolds et al. | |
| 5,562,159 | A | | 10/1996 | Smith et al. | |
| 5,570,742 | A | | 11/1996 | Reynolds et al. | |
| 5,718,289 | A | | 2/1998 | Schnatzmeyer et al. | |
| 6,347,667 | B1 | | 2/2002 | Howlett et al. | |
| 6,371,207 | B1 | * | 4/2002 | Reynolds | 166/312 |
| 6,390,190 | B1 | | 5/2002 | Mullins | |
| 6,415,862 | B1 | | 7/2002 | Mullins | |

OTHER PUBLICATIONS

Baker Oil Tools, "Casing Wiper System," 2 pages, Jan. 1, 1995.

M–I LLC, A Smith/Sclumberjer Company, "The Speedwell Thistle Cementing Brush Plug: A cost–saving alternative for wellbore clean–outs," 19 page catalog, 2001.

Baker Oil Tools Casing Wiper System, Jan. 1, 1995 2 pages.

* cited by examiner

*Primary Examiner*—Hoang Dang
(74) *Attorney, Agent, or Firm*—Steve Rosenblatt

(57) ABSTRACT

A wellbore cleanup tool and method are described. In one embodiment, the fluid is displaced with a cup seal into the tubing/drill pipe as the seal is lowered into the wellbore. In another embodiment reverse circulation directs debris into the tubing/drill pipe as it is loosened on the trip into the hole. The returning fluid laden with debris can be directed to either below the cleaning equipment or above it when used with a cup seal and a return port adjacent to it.

16 Claims, 1 Drawing Sheet

WELLBORE CLEANOUT TOOL AND METHOD

FIELD OF THE INVENTION

The field of this invention relates to devices and methods for removing wellbore debris to the surface.

BACKGROUND OF THE INVENTION

The drilling/completion process typically leaves drilling fluid and/or debris in the wellbore that needs to be cleaned up in order to improve well completion performance and to avoid damage to equipment subsequently delivered into the wellbore. This debris includes drilling fluids, cement sheaths/chunks or metallic shavings from milling or squeezing operations.

The debris can also damage the formation as well as the hardware in the wellbore. In deviated wellbores the solids loosened up by scrapers or brushes could tend to lie on the bottom if sufficient fluid velocities are not developed in the removal process.

In the past, the removal operation involved the use of brushes or scrapers that are run to bottom. Thereafter, the well is put into circulation and the debris is directed to the annular space around the string that delivered the brush or scraping tool to the well bottom. Other, techniques involve the same procedure but also add filters and magnets in an effort to collect the debris in the cleaning tool as it is being churned up. In some cases, the technique above is enhanced with pulling the tools off bottom after circulating and then circulating again, followed by returning the tools to bottom and circulating, yet again. Other techniques combine the addition of chemicals to assist in loosening up the debris. The problem with the circulation technique is that the surface equipment would rarely have the capacity to maintain turbulent flow in the surrounding annulus. As a result, the circulation technique allowed most all of the debris to settle back down in the wellbore rather than being brought to the surface with the circulating fluid.

In the past, as illustrated in several patents, there have been a variety of tools and techniques used to remove debris. U.S. Pat. No. 2,782,860 shows the use of reverse circulation into a pickup tube held by a packer inside a tubular. Several devices involve pulling vacuum on the tubular to suck fluid and debris into it. Some examples are U.S. Pat. Nos. 3,775,805; 4,630,691; 5,269,384; 5,318,128; 3,958,651 and 5,033,545 (fluid jet creates a vacuum). U.S. Pat. No. 5,402,850 uses a seal and crossover to force fluid with debris into the annulus around the tubular string for the trip to the surface. Other techniques involve reverse flow into the tubing string, such as: U.S. Pat. No. 4,944,348 and 5,069,286. Also of interest are U.S. Pat. Nos. 5,562,159 and 5,718,289.

The present invention addresses this shortcoming in the prior art by allowing the use of reverse circulation or simple fluid displacement into the tubing to maintain high fluid velocities for solids removal to the surface. Connection and release from tubing as it is being run into and out of the wellbore has been made easy with the development of tools illustrated in U.S. Pat. Nos. 6,390,190 and 6,415,862. These tools, designed principally for running in tubulars, such as casing, into a wellbore and keeping them filled or allowing circulation through the casing string to get it unstuck, now are adapted to assist in the new wellbore cleanout process. The tools described in these patents are adapted to sealingly engage the tubing supporting an inverted cup seal or/and cleaning equipment so that the loosened debris could be forced to the surface as the cup seal or/and cleaning equipment are advanced downhole. Displacement and/or reverse circulation can be used to drive fluid laden with cuttings up the tubing to the surface. At the surface, the returning cuttings and debris-laden stream can be directed to separation equipment and back to the mud pits. In a further refinement, ports can be used just downhole from a cup seal that is mounted above the cleaning equipment. Displaced or reverse circulating fluid could enter the ports directly above the cleaning equipment and below the cup seal for the return trip through the tubing to the surface. These and other advantages of the present invention can be more readily appreciated by those skilled in the art from a review of the details of the preferred embodiment described below and from the claims.

SUMMARY OF THE INVENTION

A wellbore cleanup tool and method are described. In one embodiment, the fluid is displaced with a cup seal into the tubing/drill pipe as the seal is lowered into the wellbore. In another embodiment reverse circulation directs debris into the tubing/drill pipe as it is loosened on the trip into the hole. The returning fluid laden with debris can be directed to either below the cleaning equipment or above it when used with a cup seal and a return port adjacent to it.

DETAILED DESCRIPTION OF THE DRAWINGS

DETAILED DESCRIPTION OF THE PREFERRED EMBODIMENT

Figure 1:
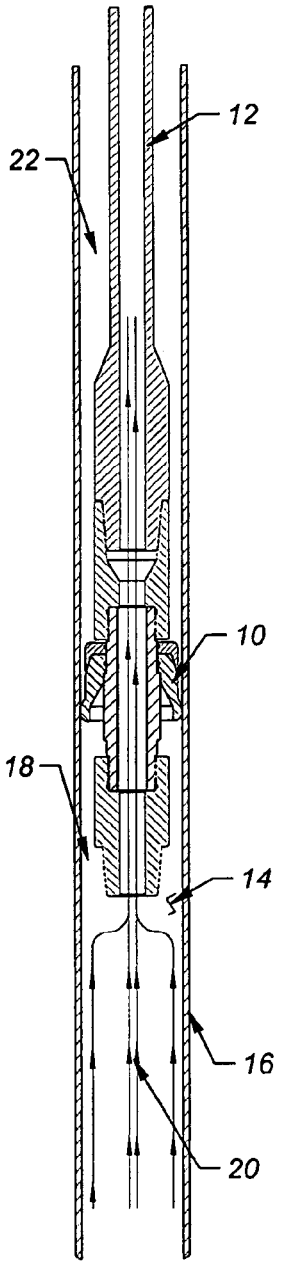
FIG. 1 is a section view showing the cup seal displacing fluid into the tubing string.

Referring to FIG. 1 an embodiment is illustrated that mounts a seal 10 to the work string 12. Seal 10 can be any one of a variety of styles but a downwardly oriented cup seal is preferred. Not shown in FIG. 1 is the top end of the work string 12 that is connected to a device described in U.S. Pat. Nos. 3,390,190 or 6,415,862 or another surface mounted device that can connect the top of the work string 12 to separation equipment so the debris can be removed prior to the fluid returning to the mud pit. While the seal 10 is advanced downhole, it cleans the debris from the inner wall 14 of the casing 16. Fluid in the annular space 18 below seal 10 is forced into the work string 12, as indicated by arrows 20. Any suspended debris or debris scraped from the inner wall 14 goes into the work string 12 as a result of advancement of seal 10. Annulus 22 above seal 10 can have fluid added into it to compensate for the downhole movement of seal 10 and to prevent high differential pressure from forming across seal 10, which could retard the further advancement of the apparatus. The displaced fluid and debris that gets into the work string 12 will be directed through a connection apparatus of the type described in U.S. Pat. Nos. 6,390,190 or 6,415,862 or another device into surface separation equipment of known design (not shown) so that the screened fluid can be returned to the mud pit for future use. Optionally, the separation equipment can be eliminated.

Figure 2:
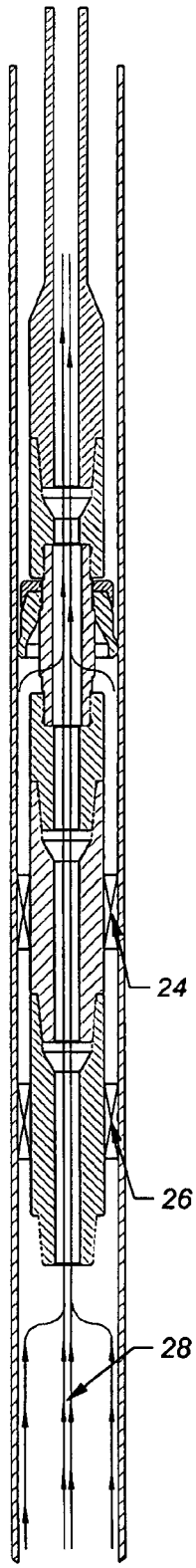
FIG. 2 is a section view showing the cleanings equipment used in conjunction with the cup seal to displace fluid into the tubing.

FIG. 2 adds a brush 24 and a casing scraper 26 to the assembly shown in FIG. 1. Other equipment to dislodge debris could be added and individual items or other combinations of equipment can be used to dislodge the debris so that it can be carried off into the work string 12, as indicated by arrows 28.

Figure 3:
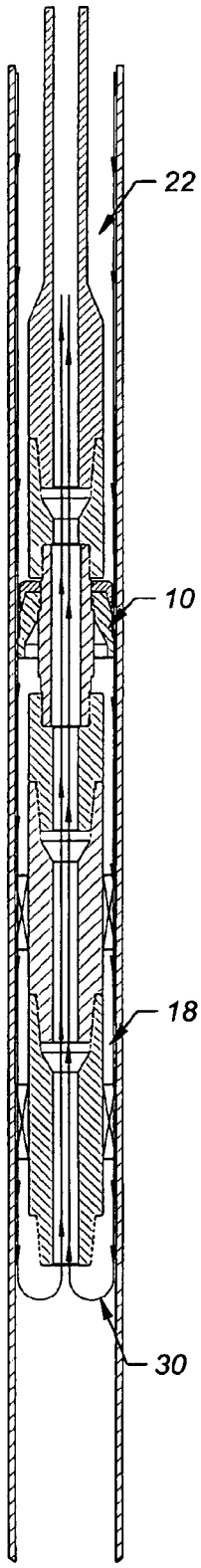
FIG. 3 is a section view similar to FIG. 2 except reverse circulation is also used.

FIG. 3, shows the equipment in FIG. 2 with the difference in method being that a reverse flow is pumped into annulus 22 from the surface. This flow displaces the seal 10 to enter annulus 18 and into the work string 12 as shown by arrows 30. In this embodiment, the movement of seal 10 downhole displaces fluid into work string 12, while at the same time the reverse circulation sweeps debris into work string 12. It is understood that while reverse flow can be used when the apparatus is fully deployed into the well so that all fluid and solids which have entered the work string 12 will be moved to the surface, it is not necessary (though it would be advantageous) to reverse circulate while the equipment is being lowered into the well.

Figure 4:
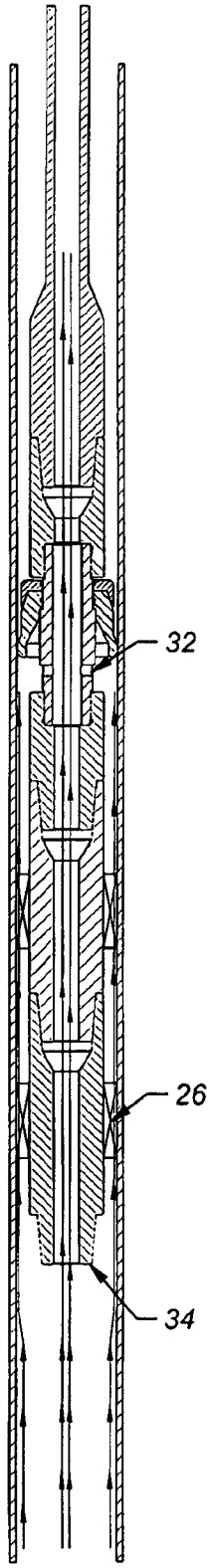
FIG. 4 is the view of FIG. 3 showing the return ports adjacent the cup seal.

FIG. 4 shows the addition of ports 32 just below the seal 10. In this embodiment, regardless of whether reverse circulation is used, the debris is displaced into ports 32 as well as into the lower end 34 of the scraper 26. The advantage here is that as soon as the debris is agitated, whether by the seal alone, as shown in FIG. 1, or by the brush 24 and scraper 26, the debris moves right into the ports 32 so it has less of a chance to settle and a greater chance to be taken to the surface with the high velocity fluid within work string 12. Ports 32 can be used with the assembly shown in FIG. 1 or 2 or some other combination of debris removal tool or tools known in the art.

Those skilled in the art will appreciate that with surface equipment that makes connecting and releasing from the work string 12 an easy matter as it is being run in, an improved well debris removal technique of the present invention can be implemented. In its various forms, it can use a cup seal such as 10 with or without ports to do the dislodging and collection of loosened debris. Alternatively, scraping equipment, involving a number of different combinations of known devices such as brushes 24 or scrapers 26 or other equipment can be used to return the debris to the surface. The cup seal 10 can be mounted on a sleeve to allow the tubular string 12 to rotate items such as brushes 24 or scrapers 26 while the seal 10 remains stationary. Tubular string 12 could be rigid tubing or coiled tubing. Here again ports such as 32 can be used or omitted and the collection of debris can proceed with only fluid displacement when moving seal 10 or in combination with reverse circulation. Seal 10 can be a downwardly oriented cup seal or it can have other forms. It need not form a perfect seal as long as it is capable of displacing enough fluid when advanced to allow debris collection in the manner described. In that sense it can be a ring that occludes the annular space and is not a seal at all. In addition it is understood that completion fluid can be placed in the annulus above seal 10 as the apparatus is being inserted into the well thereby reducing the time required to reverse the mud from the well to displace the mud system with completion fluid.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus introduced into a wellbore on a tubular having a passage therethrough for removal of debris from the wellbore through said passage to the surface, comprising:

a body having a flow path therethrough, said flow path in fluid communication with the passage in the tubular;

said body defining an annular space and further comprising an occluding member in said annular space, whereupon advancement of said body into the wellbore, said occluding member forces fluid and debris into said flow path and to the surface through the passage in the tubular;

said body further comprises a lower end and at least one port into said flow path located between said lower end of said body and said occluding member said occluding member defining an open zone between itself and said lower end of said body for receipt of fluid and debris into said port as said body is lowered for removal of debris from said wellbore.

2. The apparatus of claim 1, wherein:

said occluding member comprises a ring.

3. The apparatus of claim 1, wherein:

said occluding member comprises a seal.

4. The apparatus of claim 3, wherein:

said seal comprises a cup seal.

5. The apparatus of claim 1, wherein:

said body further comprises at least one mechanical device for dislodging debris.

6. The apparatus of claim 1, wherein:

said body further comprises at least one mechanical device for dislodging debris.

7. The apparatus of claim 1, wherein:

movement of said body alone provides the motive force through said occluding member to displace debris into said flow path.

8. The apparatus of claim 1, wherein:

movement of said body with said occluding member downhole acts in combination with pumped fluid down said annulus and around said occluding member to direct debris into said flow path.

9. The apparatus of claim 1, wherein:

movement of said body alone provides the motive force through said occluding member to displace debris into said flow path.

10. The apparatus of claim 1, wherein:

movement of said body with said occluding member downhole acts in combination with pumped fluid down said annulus and around said occluding member to direct debris into said flow path.

11. The apparatus of claim 6, wherein:

movement of said body alone provides the motive force through said occluding member to displace debris into said flow path.

12. The apparatus of claim 6, wherein:

movement of said body with said occluding member downhole acts in combination with pumped fluid down said annulus and around said occluding member to direct debris into said flow path.

13. The apparatus of claim 6, wherein:

said mechanical device comprises at least one of a brush and a scraper.

14. The apparatus of claim 1, wherein:

said occluding member is mounted to said body in a manner to allow relative rotation therebetween.

15. The apparatus of claim 1, wherein:

said occluding member comprises a cup seal having an open end directed downhole.

16. The apparatus of claim 6, wherein:

said occluding member comprises a cup seal having an open end directed downhole.

* * * * *